United States Patent [19]

Mitchell

[11] 4,261,434

[45] Apr. 14, 1981

[54] FIRE ESCAPE DEVICE

[76] Inventor: William C. Mitchell, 300 S. Chamberlain, Rockwood, Tenn. 37854

[21] Appl. No.: 94,990

[22] Filed: Nov. 16, 1979

Related U.S. Application Data

[63] Continuation-in-part of Ser. No. 969,984, Dec. 15, 1978.

[51] Int. Cl.[3] ..... A62B 1/08

[52] U.S. Cl. ..... 182/40; 182/63; 182/145

[58] Field of Search ..... 182/40, 41, 48, 63, 182/142, 145

[56] References Cited

U.S. PATENT DOCUMENTS

| | | | |
|---|---|---|---|
| 35,413 | 5/1862 | Sawyer | 182/63 |
| 163,580 | 5/1875 | Covel et al. | 182/40 |
| 212,768 | 2/1879 | Twitchell | 182/41 |
| 236,348 | 1/1881 | Mickey | 182/40 |
| 277,049 | 5/1883 | Mickey | 182/40 |
| 543,750 | 7/1895 | Painter | 182/41 |
| 722,552 | 3/1903 | Anderson | 182/63 |
| 1,557,075 | 10/1925 | McLeod | 182/63 |
| 3,016,975 | 1/1962 | Gogol | 182/48 |
| 3,088,542 | 5/1963 | Johnson | 182/48 |

*Primary Examiner*—Reinaldo P. Machado
*Attorney, Agent, or Firm*—Herman L. Holsopple

[57] ABSTRACT

A device is described which provides egress for persons trapped in burning buildings. The invention comprises a portable supportive base structure having attached thereto a plurality of interconnected channel members which are manually extended to reach the upper levels of multi-storied buildings wherein trapped victims of fire may be located. Winches attached to the device enable an operator to position the extendable members in front of an upper level window whereupon the person being removed enters a personnel receptacle attached to the terminal end of the final extendable member and is thereupon lowered safely to the ground.

7 Claims, 4 Drawing Figures

FIRE ESCAPE DEVICE

The invention herein described is a continuation-in-part of prior copending application Ser. No. 969,984, filed Dec. 15, 1978.

BACKGROUND OF THE INVENTION

The present development relates generally to fire escape devices and, more particularly, to a mechanical contrivance for extending a life saving receptacle to the immediate vicinity of an imperilled person trapped on the upper level of a burning building.

Every year numerous people are burned to death because of their inability to escape from burning buildings. Fire departments have long recognized the need for a relatively inexpensive, easily transportable piece of equipment which could be used in evacuating trapped persons from the upper levels of flame-engulfed buildings.

In 1881, U.S. Pat. No. 236,348 was issued to S. T. Mickey for a telescoping fire-escape tower apparatus which contained a flexible ladder mounted therein. Two years later Mickey was issued U.S. Pat. No. 277,049 for a similar device disposed permanently in a vault beneath the windows of a building. Both of these devices had the disadvantage that the escapee had to walk or crawl from the window sill to the door of the fire-escape tower and then climb down a flexible ladder to the ground.

Another method, considered in the past for escaping from burning buildings, has been the enclosed chute which comprises, in essence, a simple sliding board. A typical fire escape slide is described in U.S. Pat. No. 3,016,975.

A rescue device combining a segmented chute with a ladder is described in U.S. Pat. No. 3,088,542. This device is motorized and mounted to an automotive vehicle. This device has the disadvantage of being quite complex compared to the instant invention and is thus much more expensive to manufacture. The subject invention does not relate to slide or chute methods for escaping from fire.

While fire departments in many larger cities do have aerial fire trucks with long extension ladders available for rescue work, such expensive equipment is not usually available in smaller towns with lesser fire protection budgets. There is, therefore, a very real need for a relatively simple and inexpensive rescue device which can be afforded by smaller community fire departments and even volunteer fire companies.

SUMMARY OF THE INVENTION

A principal object of the present invention is to provide a mechanical contrivance for extending a life-saving receptacle to the immediate vicinity of a person imperilled by fire in a burning building.

It is another object of the invention to provide a method of egress for persons trapped in burning buildings whereby said persons can be lowered gently and safely to the ground from an upper level of a multistoried building.

It is yet another object of the invention to provide a fire escape receptacle which can be introduced directly into the window of a building and whereby a trapped person can enter the receptacle directly from his room and whereby he does not have to crawl across a dangerous catwalk or climb down a slippery or swaying ladder to safety.

It is a still further object of the invention to provide a device for rescuing persons from burning buildings which can be manufactured relatively easily and inexpensively and which can be afforded by fire departments having comparatively modest budgets.

The invention, accordingly, comprises a portable supportive base structure having attached thereto a plurality of interconnected channel members, said channel members being manually extendable by means of a winch and a series of interacting cables, and having a receptacle adapted to fit a window ledge at the terminal end of the final extendable member, said receptacle being useful for removing a trapped person from a burning building and, further, having a winch-operated cable for lowering said receptacle with a person therein safely to the ground.

DETAILED DESCRIPTION OF THE PREFERRED EMBODIMENT

Figure 1:
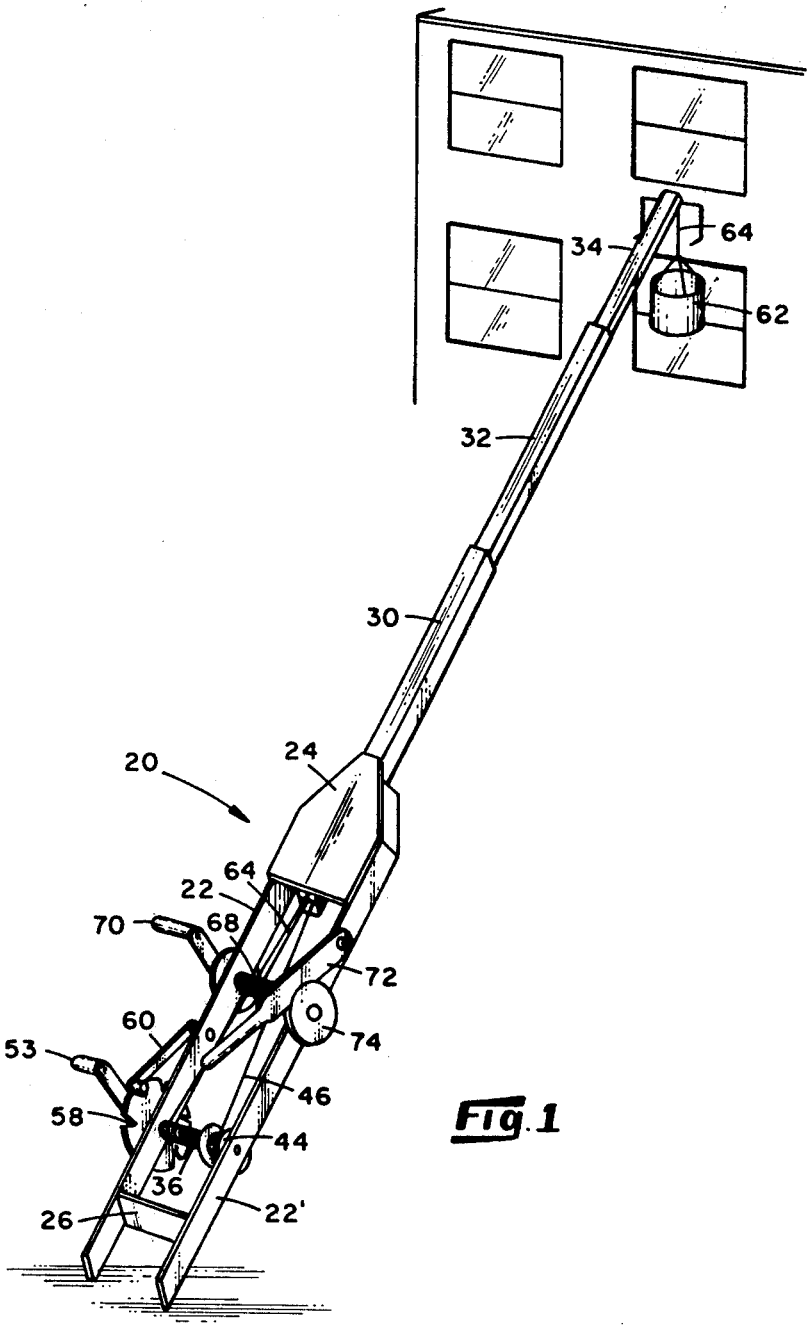
FIG. 1 is a perspective view of the device embodying the invention.
Figure 2:
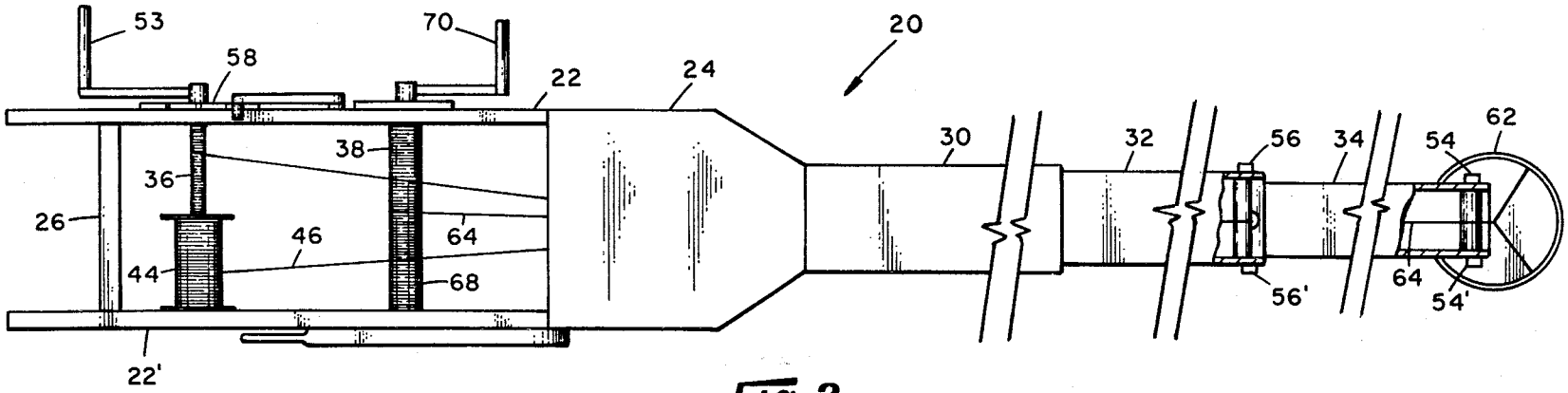
FIG. 2 is a top plan view of the subject invention.

Referring to FIGS. 1 and 2, the subject invention comprises a portable supportive base structure 20 to which the various operating components of the invention are attached.

Portable base structure 20 provides a rectangular framework comprising a first and second side member 22, 22' fixedly mounted to a forward bracing member 24 and an end bracing member 26. It is obvious that additional braces may be utilized to provide for the special structural integrity required to achieve the purpose of the invention. As seen in the perspective view of FIG. 1, portable base structure 20 is of a shape, design and size adequate to support the device of the invention mounted thereon.

In the embodiment shown, there are three interconnected channel members comprising, a first base channel member 30 fixedly and firmly fastened to supportive base structure 20; a second central channel member 32 slidably engaged within base channel member 30; and a third end channel member 34 slidably attached to central channel member 32. Not shown in the drawings but included in the invention are supporting tracks within base channel member 30 and central channel member 32 for the support and smooth travel of the interconnected central channel member 32 and end channel member 34, respectively. Square, rectangular or ovate-shaped channel members such as are generally available commercially, and having grooved rails or tracks therein so as to be slidably interconnectable are suitable for the invention described herein.

Supportive base structure 20 is provided with a means to extend and retract the plurality of interconnected channel members 30, 32, 34, said means comprising: a smaller winch 36 attached to a pull-out cable 38 which, in turn, passes over pulley 40 attached to the forward end of base channel member 30 and thence to fastener stud 42 located at the inner end of central channel member 32; and a larger winch 44 attached to a pull-back cable 46 which passes from larger winch 44 to fastener stud 48 at the inner end of end channel member 34, thence over pulley 50 along the floor of central channel member 32 and base channel member 30 to fastener stud 52 at the lower end of said base channel member 30.

Figure 3:
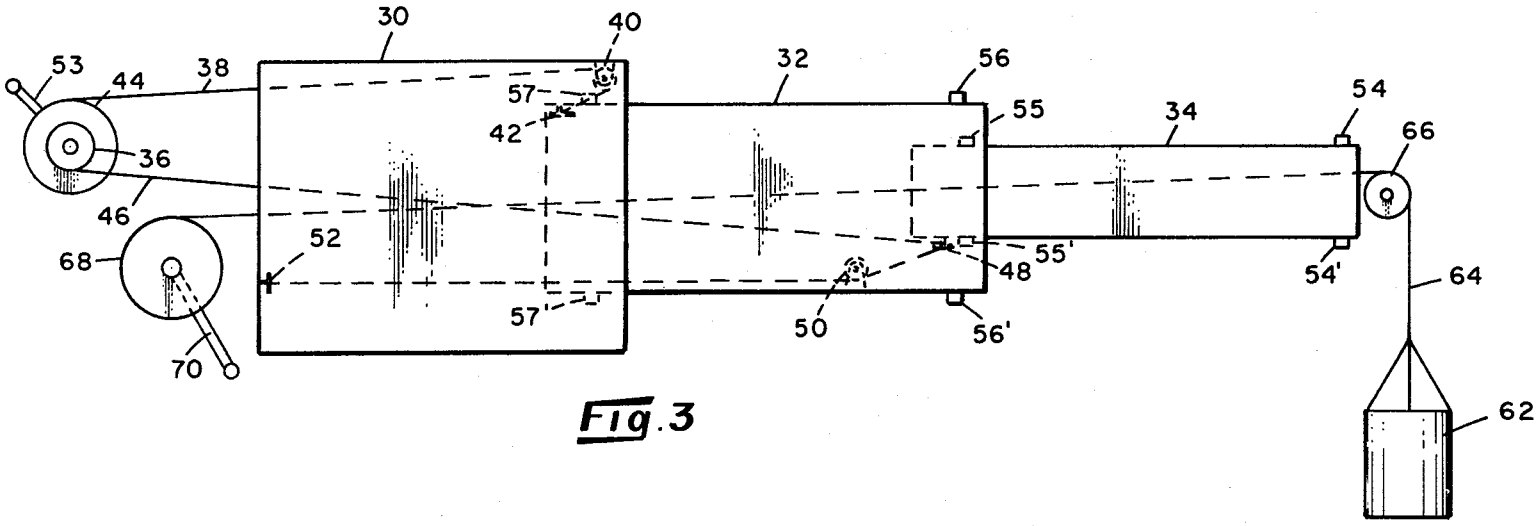
FIG. 3 is a schematic side view of the channel members of the device showing how said members are interconnected by means of cables and the manner in which the members are manually extended by means of a winch.
Figure 4:
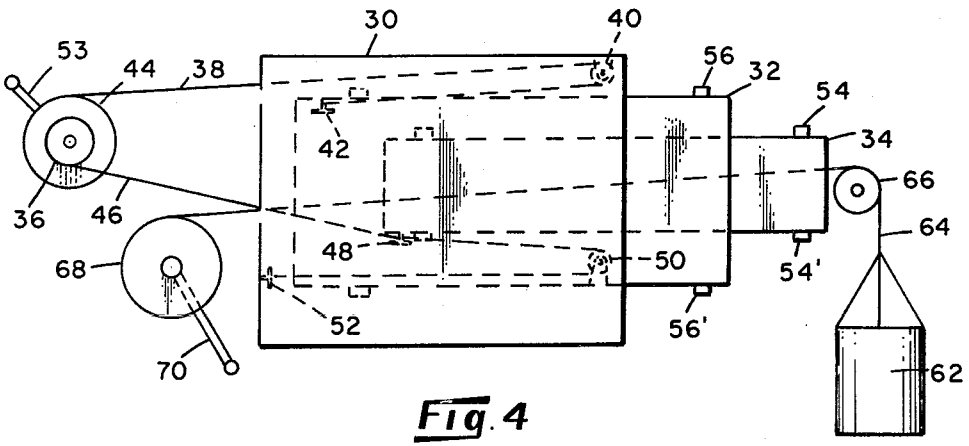
FIG. 4 is a schematic side view showing the manner in which the channel members interlock within one another when the device is retracted.

Having reference to FIG. 3 and FIG. 4, it is necessary for the operation of the invention for pull-out cable 38 and pull-back cable 46 to be wound onto opposite sides of smaller winch 36 and larger winch 44, respectively, whereby pull-out cable 38 and pull-back cable 46 always move in opposite directions. It is further required for the proper operation of the invention that winch 44 be two times the circumference of winch 36.

Referring still to FIG. 3 and FIG. 4, when larger winch 44 is turned by means of crank handle 53 in a counter clockwise manner, central channel member 32 and end channel member 34 are caused to be extended from base channel member 30. Stops 55, 55' on the rearward end of end channel member 34, and stops 57, 57' on the rearward end of central channel member 32 retain said members within central channel member 32 and base channel member 30, respectively.

Conversely, when smaller winch 36 is turned by means of crank handle 53 in a clockwise manner, cable 46 attached to fastener stud 48 is shortened thereby pulling end channel member 34 into central channel member 32 to the point at which stops 54, 54' engage the forward end of central channel member 32 whereupon central channel member 32 is drawn into base channel member 30. Similarly, stops 56, 56' prevent central channel member 32 from penetrating base channel member 30 any further than necessary.

It is important to an understanding of the invention to know that the lengths of cables wound onto winches 36, 44 is limited and critical. There is only as much pull-back cable 46 as is shown in FIG. 3 and only as much pull-out cable 38 as is shown in FIG. 4. Excess or insufficient cable is detrimental to the operation of the channel members.

To illustrate: as pull-out cable 38 is wound counter clockwise onto winch 44, and central channel member 32 is moved forward, it is necessary for the movement of end channel member 34, that pull-back cable 46 not be of unlimited length. As seen in FIG. 3 and FIG. 4, the turning of winch 36, in a counter clockwise direction, will cause pull-back cable 46 to be released. However, prior to the full extension of the channel members there is no remaining cable on winch 36 to be released. At this point a positive force is exerted on cable 46 from the direction of the fastener stud 52 over pulley 50 to fastener stud 48, in a manner similar to that exerted on fastener stud 42 by pull-out cable 38, whereby both channel members 32, 34 are fully extended.

Ratchet wheel 58 having toothed notches therearound and controlled by winch crank 53, is located outside of supportive base structure 20 on the same axle to which winches 36, 44 are mounted whereby pull-out cable 38 and pull-back cable 46 can be locked firmly in place when said ratchet wheel 58 is engaged by pawl 60.

The final components of the invention comprise a life-saving receptacle 62 adapted for entry by at least one person and means for lowering said receptacle to the ground. As seen in FIG. 1 and FIG. 2, the life-saving receptacle 62 is attached to cable 64 which passes over pulley 66 thence down channel members 34, 32, 32 to winch 68 operated by crank handle 70 and having a brake 72 operable against drum 74 to control the descent of receptacle 62.

In actual operation, the subject fire-escape device is carried by two men to a point on the ground beneath the window to which the escape device is to be extended. After extending the channel members to the window or other opening where a person is trapped by fire or other hazard, it is only necessary for the person to get into the life-saving receptacle to be quickly and easily lowered to the ground. Alternatively, the device can be mounted on a self-propelled vehicle, or in another embodiment, can be towed into place on a mobile platform.

It will be understood that the described device is not limited to extending a receptacle to a trapped person. The life-saving device could just as easily be used to extend a rope ladder or rope to a trapped person whereby said person could descend swiftly to safety.

A preferred embodiment of this invention has been set forth in the description and drawings. These descriptions are used in the generic sense only and not for purposes of limitation. Various changes may, therefore, be made therein without departing from the spirit and scope of the invention.

What is claimed is:

1. A portable fire escape device for use in rescuing persons from burning buildings which comprises, in combination:

a. a supportive base structure comprising two side members fixedly mounted to a forward bracing member and to an end bracing member, said supportive base being the structure to which the operating components are attached;

b. a single boom comprising a plurality of at least three interconnected extendable and retractable channel members attached to said forward bracing member and between said two side members;

c. means for manually extending and retracting said channel members;

d. means for locking in place said channel members in extended or retracted positions;

e. a personnel receptacle;

f. means for manually raising and lowering said personnel receptacle; and g. means for braking the descent of said personnel receptacle.

2. A portable fire escape device as set forth in claim 1 wherein said means for manually extending and retracting said channel members comprises a pair of winches having a smaller and a larger circumference, said larger circumference being two times said smaller circumference, said winches being mounted on a common axle and having cable means attached thereto.

3. A portable fire escape device as set forth in claim 2 wherein said cable means for manually extending said channel members comprises a pull-out cable having a first and second end, said first end being fixedly attached to said winch having a larger circumference, said pull-out cable extending through a pulley attached to the forward end of a first channel member, and wherein said second end of the cable is fixedly attached to the rearward end of a second channel member.

4. A portable fire escape device as set forth in claim 2 wherein said cable means for manually retracting said channel members comprises a pull-back cable having a first and second end, said first end being fixedly attached to said winch having a smaller circumference, said pull-back cable extending to a fixed attachment at the rearward end of a third channel member, thence through a pulley attached to the forward end of a second channel member and wherein said second end of the cable is fixedly attached to the rearward end of a first channel member.

5. A portable fire escape device as set forth in claim 2 wherein the means for locking the extension or retraction of said channel members comprises a ratchet wheel having toothed notches mounted to said axle common with said pair of winches and having a hinged pawl releasably engaged to said ratchet wheel whereby backward motion of said ratchet wheel is prevented.

6. A portable fire escape device as set forth in claim 1 wherein said means for manually raising and lowering said personnel receptacle comprises a pulley-mounted cable at the terminal end of said third channel member, said cable having a first and second end, said first end having attachment means for attaching said cable to said personnel receptacle and wherein said second end is fixedly attached to winch means in said supportive base structure.

7. A portable fire escape device as set forth in claim 6 wherein said means for braking the descent of said personnel receptacle comprises a brake operable against a drum mounted to an axle common with said winch means.

* * * * *